United States Patent [19]

Barton

[11] Patent Number: 4,765,520

[45] Date of Patent: Aug. 23, 1988

[54] STOCKING HOLDER APPARATUS

[76] Inventor: Jeffrey E. Barton, 8210 E. Garfield, K-13, Scottsdale, Ariz. 85257

[21] Appl. No.: 18,298

[22] Filed: Feb. 24, 1987

[51] Int. Cl.[4] ..... A47G 25/90

[52] U.S. Cl. ..... 223/111

[58] Field of Search ..... 223/111, 112, 120, 113, 223/114, 115, 116, 117, 118, 119; 248/99, 100, 101

[56] References Cited

U.S. PATENT DOCUMENTS

| | | | |
|---|---|---|---|
| D. 259,300 | 5/1981 | Vreeken . | |
| 2,443,115 | 6/1948 | Park . | |
| 2,796,207 | 6/1957 | Young . | |
| 2,828,057 | 3/1958 | MacLaughlan . | |
| 2,982,453 | 5/1961 | Zicarelli | 223/112 |
| 3,067,001 | 12/1962 | McCollum . | |
| 3,227,335 | 1/1966 | Minnema et al. . | |
| 3,237,821 | 3/1966 | Hayne et al. . | |
| 3,401,856 | 9/1968 | Berlin . | |
| 3,695,493 | 10/1972 | Karr . | |
| 4,002,276 | 1/1977 | Poncy et al. . | |
| 4,031,689 | 6/1977 | Sullivan | 248/99 X |
| 4,066,194 | 1/1978 | Leland . | |
| 4,069,913 | 1/1978 | Harrigan . | |
| 4,159,069 | 6/1979 | Poncy et al. . | |
| 4,228,935 | 10/1980 | Madray . | |
| 4,275,812 | 6/1981 | Poncy et al. . | |
| 4,488,697 | 12/1984 | Garvey | 248/101 |
| 4,497,424 | 2/1985 | Smith | 223/111 |
| 4,549,748 | 10/1985 | Haley, Sr. | 248/99 X |
| 4,637,533 | 1/1987 | Black | 223/112 |

FOREIGN PATENT DOCUMENTS

| | | | |
|---|---|---|---|
| 1442313 | 7/1976 | United Kingdom | 223/111 |

*Primary Examiner*—Robert R. Mackey

*Attorney, Agent, or Firm*—H. Gordon Shields

[57] ABSTRACT

Stocking holder apparatus includes a flexible wire frame on which a stocking is placed and is held in place while a user inserts a foot into the stocking. The frame supports the stocking so that the toe of the stocking is accessible to the user of the apparatus. The user makes contact with the toe of the stocking first, and the user's foot moves downwardly through the frame such that the stocking slides off of the frame and onto the user's leg.

6 Claims, 1 Drawing Sheet

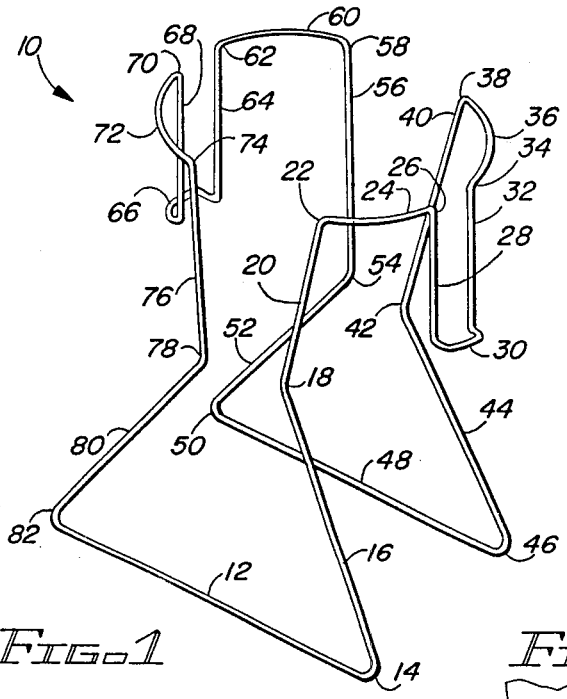
FIG. 1
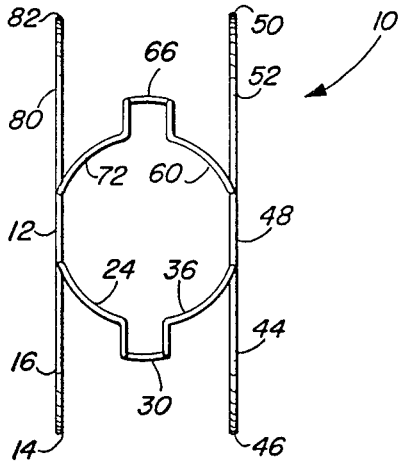
FIG. 2
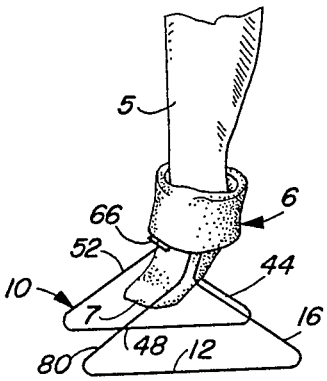
FIG. 3A
FIG. 3B
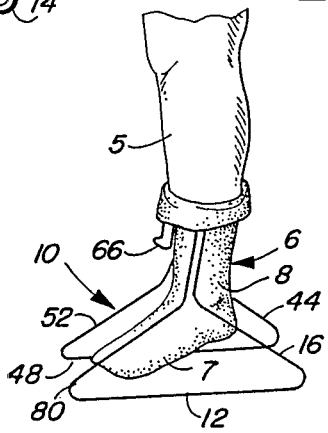
FIG. 3C
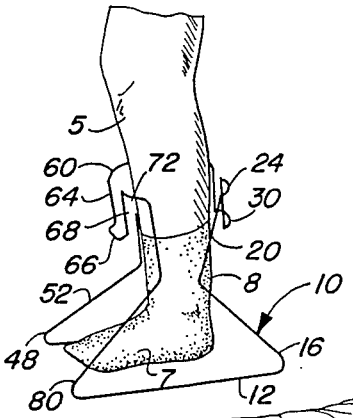
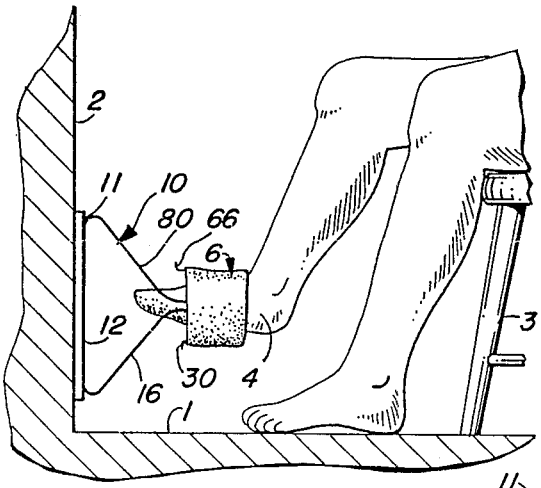
FIG. 4
FIG. 5A
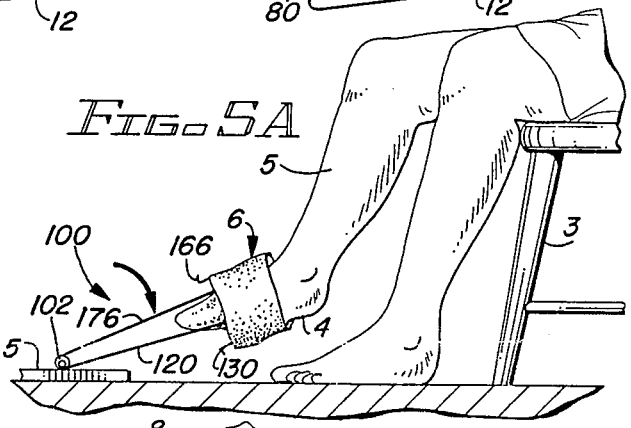
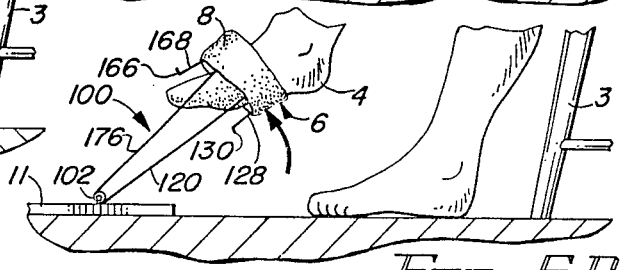
FIG. 5B

STOCKING HOLDER APPARATUS

BACKGROUND OF THE INVENTION

1. Field of the Invention

This invention relates to stocking holder apparatus and, more particularly, to a wire frame which supports a stocking and through which a user's foot moves to cause the stocking to slide onto the user's foot and leg from the frame.

2. Description of the Prior Art:

U.S. Pat. No. Des. 259,300 (Vreeken) discloses an ornamental design for a stocking holder which includes a generally rectangularly shaped frame which supports a stocking. Since the '300 patent is a design patent, instructions on the use of the apparatus are not included.

U.S. Pat. No. 2,443,115 (Park) discloses a ring structure with handle extending axially outwardly from the ring. The upper portion of a stocking is placed on the ring, and the user holds the handle and moves the handle upwardly along the user's leg to cause the stocking to be moved onto the user's foot and leg.

U.S. Pat. No. 2,796,207 (Young) discloses a foot and leg form about which is disposed a stocking. At the upper portion of the form are buttons to which a handle, similar to the handle of the '115 patent, are secured. A stocking is placed over the form, and the handle is held while the user's foot extends through the form to place the stocking on the user's leg. The form is withdrawn from the stocking when the stocking has been partially placed on the user's leg.

U.S. Pat. No. 2,828,057 (MacLaughlan) discloses a stocking holder which includes a foot form portion and two side frames secured to the foot portion. A stocking is placed on the foot form and the frames, and the user's foot is placed into the stocking and into the form. Handles are secured to the wire forms for holding the apparatus while the apparatus is being used. After the user's foot is initially into the toe portion of the stocking, the form may be withdrawn. When the stocking is originally put onto the form, elastic straps may be secured to the tops of the stocking. When the form is withdrawn from the stocking after the user's foot is initially into the stocking, the stocking may be pulled up by means of the elastic straps.

U.S. Pat. No. 2,982,453 (Zicarelli) discloses a platform which includes two forms extending upwardly from the platform about two apertures which extend through the platform. The forms hold stockings, and the user's foot extends through the forms and through the openings in the platform to aid in putting the stockings onto the foot of the user. Spring bands are disposed about the forms to help hold the stockings in place while a user's feet are being inserted into the socks through the forms and the apertures.

U.S. Pat. No. 3,067,001 (McCollum) discloses glove apparatus used for sterilizing gloves and for holding the gloves while a user inserts the user's hands into the gloves so that the gloves may be placed on the user's hands without contact with the outer portion of the gloves by anyone.

U.S. Pat. No. 3,227,335 (Minnema et al) discloses a ring structure for holding socks. A handle extends upwardly from the ring structure, and a plurality of prongs extend upwardly and outwardly from the ring structure. A stocking is wound about the prongs and the user inserts a foot through the ring and into the stocking.

U.S. Pat. No. 3,401,856 (Berlin) discloses a semi-tubular form which is adapted to hold a stocking and through which a user's foot extends to help put the stocking on the user's foot and leg. Straps are secured to the form and may be used to pull the form upwardly along the user's leg, and at the same time pull up the stocking disposed about the form.

U.S. Pat. No. 3,237,821 (Hayne et al) discloses a glove changing method and apparatus by which a user may change gloves in a glove changer box. The apparatus includes a fixed box having a ring which includes provisions for holding a glove, and a separate, complementing ring, which may also hold a glove, and which fits over the glove on the fixed ring.

U.S. Pat. No. 3,695,493 (Karr) discloses another glove changing apparatus which includes a ring for holding a glove at the upper part of a cylindrical chamber. The chamber includes bellows at the lower portion of it so that extension of the bellows causes a low pressure situation which causes the glove to expand from the form. The expanded glove is accordingly easily removed or applied, as required.

U.S. Pat. No. 4,002,276 (Poncy et al) discloses another type of glove changing apparatus which also includes a ring for holding the cuff of a glove. The glove is inserted into a chamber, and a tubular arrangement causes pressure change in the chamber for expanding the glove for the easy insertion of a hand into the glove.

U.S. Pat. No. 4,066,194 (Leland) discloses a sock donning apparatus which includes a wire frame and a handle extending upwardly from the frame. A sock is put onto the frame, and the foot of a user extends through the frame into a sock. The frame is then withdrawn from the sock.

U.S. Pat. No. 4,069,913 (Harrigan) discloses another surgical glove type apparatus or package which includes a ring which holds the cuff of a glove. The glove is secured to the ring, and the ring is inserted into a fixture which includes a chamber from which air is evacuated to cause the glove to expand, and the hand is then inserted into the expanded glove.

U.S. Pat. No. 4,159,069 (Poncy et al) discloses another type of surgical glove package also usable with a chamber which may be evacuated to cause a glove to expand.

U.S. Pat. No. 4,228,935 (Madray) discloses a rack apparatus for holding gloves. The rack includes a pair of apertures or recesses which receive rings, and the gloves are secured to the rings. The hands are inserted through the rings and into the gloves, and the gloved hands of the user are then withdrawn from the aperture. The rings are defined as cuff portions of the gloves, and accordingly are integral with the gloves. When the gloves are to be removed, the ring or cuff portion of the glove is again inserted into the apertures in the rack, and the user's hands are then withdrawn from the gloves. The gloves remain in the rack until they are to be used again.

U.S. Pat. No. 4,275,812 (Poncy et al) discloses still another surgical glove package utilizing a pair of rings for holding a glove in place. The gloves are disposed in a bag, and when the user's hand is inserted into the gloves, the bag is turned inside out in order to remove the bag and the ring elements to free the gloves.

U.S. Pat. No. 4,497,425 (Smith) discloses a ring system for holding a sock. The ring includes downwardly depending legs, and a sock is disposed about the legs and beneath the ring. The user's foot is inserted into the sock through the ring.

It will be immediately noted that the apparatus of the prior art may be divided into two categories. One category is a sock holder apparatus and the other category is glove holding apparatus. Each of the patents in both categories includes some arrangement for holding either a sock or a glove.

SUMMARY OF THE INVENTION

The invention described and claimed herein comprises a separable wire frame on which a stocking or sock is disposed substantially completely so that the stocking or sock is held open, with the toe portion of the sock contacted by the user's foot. As the user inserts the foot into the sock, and through the frame, the sock slides off of the frame and onto the user's foot and leg. The frame is self-supporting, and includes two tubular separate sock holding portions, including an upper half ring portion on each of the parts, and each of the half ring portions includes a downwardly depending loop portion with an outwardly extending loop at the lower portion of the downwardly depending loop. Portions of the sock are rolled or slid or pushed onto the downwardly depending and outwardly depending loops for holding the sock during insertion of the foot into the sock. The two half ring portions are spaced apart slightly from each other, but may be disposed substantially against each other while the sock is being placed on the ring portions. The inherent bias of the ring portions helps to hold the sock in an open position for easy insertion of the user's foot into the sock and within the frame, including the half ring portions. The half ring portions are at the upper portion of the frame, and they are located away from a base portion of the frame a sufficient distance to allow a sock to be fully disposed on a user's foot before the user's foot contacts the floor within the bottom or base portion of the frame.

Among the objects of the present invention are the following:

To provide new and useful sock holding apparatus;

To provide new and useful apparatus for holding a sock while a user inserts a foot into the sock;

To provide new and useful apparatus including a wire frame for holding a sock;

To provide new and useful wire frame including a base portion and a pair of half ring portions for holding a sock;

To provide new and useful wire form apparatus for holding a sock; and

To provide new and useful frame apparatus including a pair of separable forms for holding a sock while a user inserts a foot into the sock and through the form.

BRIEF DESCRIPTION OF THE DRAWING

FIG. 1 is a perspective view of the apparatus of the present invention.

FIG. 2 is a top view of the apparatus of the present invention.

FIG. 3A is a side perspective view of the apparatus of the present invention in its use environment and showing a beginning sequence of a user of the apparatus.

FIG. 3B is a side perspective view sequentially following FIG. 3A and illustrating the use of apparatus of the present invention.

FIG. 3C is a side perspective view sequentially following FIG. 3B and illustrating the use of the apparatus of the present invention.

FIG. 4 is a side view illustrating another use environment of the apparatus of the present invention.

FIG. 5A is a side view illustrating the operation of an alternate embodiment of the present invention.

FIG. 5B is a side view sequentially following FIG. 5A and illustrating the use of the alternate embodiment of the apparatus of the present invention.

DESCRIPTION OF THE PREFERRED EMBODIMENT

FIG. 1 is a perspective view of stocking holder apparatus 10 of the present invention. The stocking holder apparatus 10 is preferably made of relatively stiff but flexible wire elements. The wire elements form a continuous stocking holder frame which is substantially symmetrical and which may be considered to include two relatively movable frame portions. The two relatively movable frame portions extend in opposite directions from a pair of base elements, including a base element 12 and a base element 48.

FIG. 2 is a top view of stocking holder apparatus 10 of FIG. 1.

FIGS. 3A, 3B, and 3C are sequential views illustrating the stocking holder apparatus 10 in its use environment, with a stocking 6 secured to the apparatus, and a user's foot 4 sequentially moving into the stocking 6. The foot is connected to a user's leg 5.

For the following discussion, reference will be made primarily to FIGS. 1, 2, 3A, 3B, and 3C.

The stocking holder apparatus 10 includes the base element 12, which is a length of wire. At opposite ends of the base 12 are a pair of bends, including a bend 14 and a bend 82. Extending upwardly from the bend 14, and inwardly, or towards the center of the base 12, is a portion or element 16. Extending upwardly and inwardly from the bend 82 is an inwardly and upwardly extending portion or element 80. The portions 16 and 80 extend generally towards each other and are in the same plane as the base element 12. At the upper end of the portion 16 is a bend 18. Another upwardly extending element or portion 20 is connected to the portion 16 by the bend 18. At the upper end of the element 20, remote from the bend 18, is a bend 22. A relatively short curved portion or element 24 extends arcuately from the bend 22. At the end of the relatively short curved element 24, remote from the bend 22, is a bend 26. Extending downwardly from the bend 26 is a relatively short downwardly extending element or portion 28.

An outwardly extending generally U-shaped portion or element 30 extends outwardly from the bottom of the downwardly extending element 28. The U-shaped element 30 comprises a pair of generally horizontally extending arms connected to a relatively wide center portion.

Extending upwardly from the outwardly extending element 30 is a generally upwardly extending portion or element 32. The element 32 is substantially parallel to the element 28. A bend 34 is located at the upper end of the element 32. A relatively short curved portion or element 36 extends arcuately from the bend 34 to a bend 38. A downwardly extending portion or element 40 then joins the bend 38 and extends to another bend 42. From the bend 42, a downwardly and outwardly extending portion or element 44 is disposed generally parallel to the upwardly and inwardly extending portion 16. The element 44 is joined to the base 48 by a curved portion 46.

A bend 50 is at the opposite end of the base portion or element 48, remote from the bend 46. From the bend 50, an upwardly and inwardly extending portion or element 52 extends to another bend 54. An upwardly extending element 56 extends from the bend 54 to a bend 58. From the bend 58, a relatively short curved portion or element 60 extends to a bend 62. Extending downwardly from the bend 62 is a portion or element 64. At the bottom of the element 64, there is another outwardly extending portion or element 66. The outwardly extending element 66 is substantially identical to the outwardly extending element 30 in configuration.

An upwardly extending portion or element 68 is disposed generally parallel to the downwardly (or upwardly) extending element 64. At the top of the upwardly extending element 68, remote from the outwardly extending element 66, a bend 70 provides a transition to another relatively short arcuately extending portion or element 72. At the end of the relatively short arcuately extending element 72, remote from the bend 70, is a bend 74. A downwardly extending portion or element 76 is connected to the bend 74. At the bottom of the generally downwardly extending portion 76, remote from the bend 74, is a bend 78. The bend 78 comprises a transition to the generally upwardly and inwardly extending portion 80.

As will be best seen and understood from FIGS. 1 and 2, the stocking holder apparatus 10 is substantially symmetrical in either of two ways. A plane could bisect the base elements 12 and 48 and extend upwardly between the elements 20, 40 and 56, 76 to divide the stocking holder apparatus 10 into two symmetrical frames, the upper portions of which, remote from the base elements 12 and 48, are relatively movable, as required. Similarly, a plane could bisect the outwardly extending elements 30 and 66, between the generally parallel elements 28, 32 and 64, 68 to divide the apparatus 10 into another pair of substantially symmetrical frame portions. However, the first method is preferable for illustrative purposes. That is, the apparatus 10 may be considered as including base elements 12 and 48 and the relatively movable, and substantially symmetrical, mirror image frame portions secured to opposite ends of the frame base elements.

As is best shown in FIG. 2, the arcuately extending elements 24, 36, 60, 72 are segments of a circle. They comprise connecting elements between the upwardly extending elements 20, 40 and 56, 76, and the respective downwardly extending elements 28, 32 and 64, 68.

The outwardly extending elements 30 and 66, with their upwardly extending portions 28, 32 and 64, 68 respectively, comprise rack elements on which the upper portions of stockings may be disposed, along with the upwardly/downwardly extending elements 20, 40 and 56, 76. In such case, the arcuately extending portions 24, 36, 60, 72 comprise a circular outline on which a stocking or sock is disposed. The outwardly extending elements 30 and 66 also comprise connective elements between the downwardly extending elements 28, 32 and 64, 68, respectively.

As illustrated in FIGS. 3A, 3B, and 3C, and also illustrated in FIG. 4, which will be discussed below separately, with a stocking 6, which includes a foot portion 7 and a leg portion 8, disposed on the holder apparatus 10, a user's foot 4 may be inserted directly into the foot portion 7 of the stocking 6. A successive downward or inward movement of the foot 4 causes the leg portion 8 of the stocking 6 to slide off the frame apparatus 10, as shown in FIG. 3B, until the user's foot 4, and also a lower leg 5, is fully within the stocking 6. The stocking 6 slides off the holder apparatus 10 and onto the user's ankle and lower leg as the foot 4 and the foot portion 7 of the sock move downwardly through the apparatus 10. In FIG. 3C, the user's foot is flat on the floor or platform (not specifically shown) on which the apparatus 10 is disposed, and the stocking 6 is completely off the holder apparatus 10.

It will be understood that the apparatus 10 is flexible to allow the frame portions to move towards and away from each other, and to allow the individual frame elements to move relative to each other, as desired and as required.

When the vertical portions 20, 40, 56 and 76 are generally parallel and aligned with each other, as shown in FIGS. 3A and 3B, with the stocking 6 secured thereto, the holder apparatus 10 is in its minimum diameter configuration. However, when a user's foot is fully disposed within a stocking, and with the stocking off the apparatus 10, as shown in FIG. 3C, then the apparatus 10 may be conveniently spread apart to allow a user's foot to be easily removed from the apparatus. It will be understood that the use of the apparatus 10 will be primarily by users with some type of physical limitations, and the flexibility of the apparatus, its ability to move, etc., is thus of substantial importance in allowing a user's foot, with a stocking secured thereto, to be removed from within the apparatus. Or, in a reverse type phrasing, the flexibility of the apparatus in allowing it to be removed from a user's foot is of substantial importance. This may be easily understood from FIG. 3C.

FIGS. 1, 2, 3A, 3B, and 3C illustrate the stocking holder apparatus 10 in a particular orientation in which the base elements 12 and 48 are on a relatively flat floor 1. There may be occasions when having the base elements 12 and 48 disposed on a wall 2, or on a vertically extending surface, or post, etc., may be advantageous. Such is illustrated in FIG. 4. In FIG. 4, a user is shown in a seated position on a chair 3, with the foot 4 extending into the stocking 6. The stocking 6 is in turn disposed on the apparatus 10. The stocking holder apparatus 10 is secured to a vertically extending wall 2. The base elements 12 and 48 are secured on a base or platform 11 which is in turn secured to the wall 2, and thus for definitional purposes, the apparatus 10 is extending generally horizontally, instead of the generally vertical orientation illustrated in FIGS. 1, 2, 3A, 3B, and 3C.

FIGS. 5A and 5B illustrate an alternate embodiment 100 of the stocking apparatus 10 of FIGS. 1–4. Alternate embodiment stocking holder apparatus 100 of FIGS. 5A and 5B comprises a pivoting embodiment in which the base members 12 and 48, and the generally upwardly and inwardly extending members 16, 44, 52, and 80, which extend upwardly and inwardly from opposite ends of the base members 12 and 48, are replaced by a base hinge 102 and elongated upwardly extending elements. The generally upwardly extending elements shown in FIGS. 5A and 5B include upwardly extending elements 120 and 176. The elements 120 and 176 are generally aligned with each other, and essentially comprise extensions or elongated continuations of the generally upwardly extending elements 20 and 76 of the stocking holder apparatus 10. Not shown in FIGS. 5A and 5B are parallel generally upwardly extending elements which are comparable to the upwardly extending elements 40 and 56 of stocking holder apparatus 10.

In the alternate embodiment stocking holder apparatus 100, the upper frame portion is substantially identical to that of the apparatus 10. That is, four relatively short curved elements, together with their generally downwardly extending element pairs, and the outwardly extending elements, are included in the alternate element apparatus 100. In FIGS. 5A and 5B, the outwardly extending elements 130 and 166 are shown. The outwardly extending elements 130 and 166 are substantially identical to the outwardly extending elements 30 and 66 of the apparatus 10.

In FIG. 5B, generally downwardly extending elements 128 and 168 are shown connected respectively to the outwardly extending elements 130 and 166. The stocking or sock 6 is shown in FIG. 5A as being placed on the generally downwardly extending elements adjacent to the generally outwardly extending elements 130 and 166. The user's foot 4 is shown being inserted into the stocking 6, with the foot nearly all of the way into the foot portion 7 of the stocking 6.

In FIG. 5B, the apparatus 100 is shown pivoted from the position shown in FIG. 5A. Such pivoting may be required for a user, disposed on the chair 3, to conveniently insert the foot 4 into the stocking 6.

The base hinge 102 is shown disposed on, and secured to, a plate 11, which is in turn disposed on the floor 1.

As with the apparatus 10, the apparatus 100 is symmetrical, and its frame halves, which may be defined as including, for one-half, the generally upwardly extending member 120, the generally downwardly extending member 128, and the outwardly extending member 130. The other half includes the generally upwardly extending member 176, the generally downwardly extending member 168, and the generally outwardly extending member 166. The frame halves may move independently of each other, and thus may spread apart, as with the frame halves of the apparatus 10. The spreading of the frame halves of the apparatus 10 is best shown in FIG. 3C. In FIG. 5B, the two frame halves are shown spread apart slightly more than they are shown in FIG. 5A. In FIG. 5A, the two frame halves are shown relatively close together, as in a beginning use position.

The stocking holder apparatus 100 is also, like apparatus 10, preferably made of spring steel rod or wire to facilitate its movement, its relative movement, etc.

It will be understood that the stocking holder apparatus 10 and 100 may be made in pairs for convenience in holding a pair of panty hose, or the like. In such case, it may be preferable to have the pair fastened to a base plate, such as the base plate 11 shown in FIGS. 4, 5A and 5B.

In the operation of the stocking holder apparatus 10 and 100, it will be noted that the user's foot 4 extends directly into the foot portion 7 of the stocking being held by the apparatus. The leg portion 8 of the stocking 6 is disposed on the outside of the frame which includes the generally upwardly extending elements 20, 40 and 56, 76 and the generally downwardly extending elements 28, 32, and 64, 68 for the apparatus 10, and the corresponding elements of the apparatus 100. The frame also includes the circular elements or portions 24, 36, 60, and 72 for the apparatus 10, and the corresponding elements for the apparatus 100. Thus, the user's foot 4 goes directly into the foot portion 7 of the stocking 6. Then the leg portion 8 of the stocking 6 "rolls" or slides off the frame of the stocking holder apparatus and onto the user's legs as the user's foot 4 is pushed downwardly through the apparatus. This is illustrated in the sequential views of FIGS. 3A, 3B, and 3C.

It will be noted that the user's foot 4 does not move frictionally through or against any portion of the stocking 6. Rather, essentially the entire stocking 6 is disposed on the outside of the frame of the stocking holder apparatus, with only the toe portion initially contacted by a user's foot. In FIG. 4, the toe portion is shown loosely disposed on the frame, with the rest of the stocking on the outside of the frame. The user's foot is shown partially in the front part of the foot portion, including the toe portion, of the stocking 6. If desired, the toe portion may be tighter, such that the entire stocking is essentially inverted or inside out with respect to the frame and the user's foot. However, regardless of how tight or how loose the toe portion is secured to the apparatus 10, the user's foot first contacts the toe portion of the stocking, and as the user's foot continues into the frame, as sequentially illustrated in FIGS. 3A, 3B, and 3C, the respective portions of the stocking roll or slide off the frame and directly onto the corresponding portions of the foot and leg.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention.

What I claim is:

1. Apparatus for holding a stocking having a foot portion and a leg portion while a user inserts a foot into the stocking and made of generally flexible material and of continuous construction, comprising, in combination:

base means, including a first base element and a second base element, each of which includes a first end and a second end;

first flexible frame means connected to and extending upwardly from the base means, including a first pair of generally upwardly and inwardly extending elements secured to the first ends of the first and second base elements, a first pair of generally upwardly extending elements secured to the first pair of generally upwardly and inwardly extending elements, a first pair of generally downwardly extending elements connected to and disposed between the first pair of generally upwardly extending elements, first connecting means for connecting the first pair of generally upwardly extending elements and the first pair of generally downwardly connecting elements, and second connecting means for connecting the first pair of generally downwardly extending elements remote from the first connecting means; and second frame means connected to and extending upwardly from the base means aligned with and movable relative to the first frame means, including a second pair of generally upwardly and inwardly extending elements secured to the second ends of the first and second base elements, a second pair of generally upwardly extending elements secured to the second pair of generally upwardly and inwardly extending elements, a second pair of generally downwardly extending elements disposed between the second pair of generally upwardly extending elements, third connecting means for connecting the second pair of generally upwardly extending elements and the second pair of generally downwardly extending elements, and fourth connecting means for connecting the second pair of generally downwardly extending elements remote from the third connecting means, and the foot portion of the stocking is disposed between the first frame means and the second frame means, and the leg portion of the stocking is disposed on the first and second frame means and slides off the first and second frame means as a user's foot is extended into the foot portion of the stocking and is moved through the first and second frame means.

2. The apparatus of claim 1 in which the base means further includes hinge means, and the first and second pairs of generally upwardly extending members are secured to the hinge means.

3. Apparatus for holding a stocking having a foot portion and a leg portion while a user inserts a foot into the stocking, made of generally flexible material, comprising, in combination:

base means, including hinge means for pivoting the apparatus;

first flexible frame means connected to the hinge means, including a first pair of generally upwardly extending elements, a first pair of generally downwardly extending elements disposed between the first pair of generally upwardly extending elements, first connecting means for connecting the first pair of generally upwardly extending elements and the first pair of generally downwardly connecting elements, and second connecting means for connecting the first pair of generally downwardly connecting elements remote from the first connecting means; and second flexible frame means connected to the hinge means including a second pair of generally upwardly extending elements, a second pair of generally downwardly extending elements disposed between the second pair of generally upwardly extending elements, third connecting means for connecting the second pair of generally upwardly extending elements and the second pair of generally downwardly extending elements, and fourth connecting means for connecting the second pair of generally downwardly extending elements remote from the third connecting means, and the foot portion of the stocking is disposed between the first frame means and the second frame means, and the leg portion of the stocking is disposed on the first and second frame means and slides off the first and second frame means as a user's foot is extended into the foot portion of the stocking and is moved through the first and second frame means.

4. The apparatus of claim 3 in which the first connecting means and the third connecting means comprise arcuately extending elements.

5. The apparatus of claim 4 in which the second and fourth connecting means comprise outwardly extending elements.

6. The apparatus of claim 2 in which the base means further includes a base platform element, and the hinge means is secured to the base platform element.

* * * * *